US011132014B2

(12) United States Patent
Provini

(10) Patent No.: US 11,132,014 B2
(45) Date of Patent: Sep. 28, 2021

(54) REPOSITIONABLE CONTROL KNOB ASSEMBLY AND METHOD OF USE

(71) Applicant: Christopher Provini, River Vale, NJ (US)

(72) Inventor: Christopher Provini, River Vale, NJ (US)

( * ) Notice: Subject to any disclaimer, the term of this patent is extended or adjusted under 35 U.S.C. 154(b) by 0 days.

(21) Appl. No.: 17/168,334

(22) Filed: Feb. 5, 2021

(65) Prior Publication Data

US 2021/0247796 A1 Aug. 12, 2021

Related U.S. Application Data

(60) Provisional application No. 62/970,824, filed on Feb. 6, 2020.

(51) Int. Cl.

| | |
|---|---|
| ***G05G 1/10*** | (2006.01) |
| ***G05G 5/06*** | (2006.01) |
| ***H01H 19/14*** | (2006.01) |
| ***G05G 1/08*** | (2006.01) |
| ***G05G 5/05*** | (2006.01) |
| ***G05G 5/04*** | (2006.01) |
| *H01C 10/00* | (2006.01) |

(52) U.S. Cl.

CPC ..... *G05G 1/08* (2013.01); *G05G 5/04* (2013.01); *G05G 5/05* (2013.01); *G05G 5/06* (2013.01); *H01H 19/14* (2013.01); *G05G 2505/00* (2013.01); *H01C 10/00* (2013.01)

(58) Field of Classification Search

CPC .. G05G 1/08; G05G 1/12; G05G 5/04; G05G 5/05; G05G 5/06; G05G 2505/00; H01H 19/11; H01H 19/14; H01C 10/00

See application file for complete search history.

(56) References Cited

U.S. PATENT DOCUMENTS

| | | | | |
|---|---|---|---|---|
| 3,561,287 | A | 2/1971 | Lawrence, Jr. | |
| 6,710,565 | B2 * | 3/2004 | Maeda | B60K 37/06 318/466 |
| 2017/0060169 | A1 | 3/2017 | Stroh et al. | |
| 2018/0038478 | A1 * | 2/2018 | Arakawa | B60K 20/08 |

OTHER PUBLICATIONS

Guitar Clutch, Clutch—The Sound Marker, Dec. 8, 2016, https://www.youtube.com/watch?v=qMWRlkDLolo.

* cited by examiner

*Primary Examiner* — Adam D Rogers

(74) *Attorney, Agent, or Firm* — John H. Choi & Associates

(57) ABSTRACT

A control knob assembly includes a rotating shaft coupled with a controllable device. A base is fixed to a mounting surface where the rotating shaft extends therethrough. A fork includes a detent and a tab. The fork is positioned on top of the base and slidably engaged therewith. A gear includes teeth configured to receive the detent and an upper groove. The gear is positioned on top of the fork with the rotating shaft extending therethrough. A knob includes a cavity that is fixedly engaged to the rotating shaft above the base, fork and gear, with the tab extending radially outwardly from underneath the knob. A biasing member is secured to the knob and is configured to engage the gear upper groove such that when engaged the gear rotates with the knob. A set position is established and repositioned by engaging the tab.

20 Claims, 18 Drawing Sheets

REPOSITIONABLE CONTROL KNOB ASSEMBLY AND METHOD OF USE

CROSS-REFERENCE TO RELATED APPLICATION

This application claims priority to U.S. Provisional Application No. 62/970,824, filed on Feb. 6, 2020, entitled "Repositionable Detent for a Control Knob," which is incorporated by reference in its entirety.

FIELD

The present disclosure relates to control knobs and in particular to a repositionable control knob assembly and method of using the same.

BACKGROUND

Control knobs typically utilize a potentiometer which rotates freely between a maximum setting and a minimum setting. Examples of control knobs include guitar knobs, tone knobs, and volume knobs. In addition, control devices with rotating variable resistors may be incorporated into musical devices, such as guitars, amplifiers, effects pedals, keyboards, mixing boards, etc. Fixing the rotatable portion of the potentiometer or other rotating variable resistors to a position between the maximum and minimum settings allows for customized settings desirable to a user. However, to recall any customized setting, the user must remember the exact rotational position of the knob.

Control knobs of musical instruments and accessories typically utilize a potentiometer which rotates freely between a maximum and a minimum setting. As mentioned above, examples of control knobs can be found on electric guitars/basses, where each control knob affects a certain characteristic of the sound that the instrument produces, for example, volume and tone control knobs. Within the range of a potentiometer's rotation, there are settings which can be desirable.

A need exists for a knob which allows for tactile confirmation of the attainment of a previously customized setting.

Furthermore, there are some situations during use of a knob in which a user needs to rapidly recall a specific setting, such as mid-performance when the knob controls a musical instrument. In mid-performance, it is neither practical nor possible for a performer to recall a specific setting by sight, sound, or memory. In addition, many musicians employ multiple instruments or musical equipment, such as amplifiers with rotatable knobs, and so remembering or recalling individual settings for each knob of such instruments or equipment becomes tedious and impractical.

A need exists for a knob which attains a customized rotational setting which does not rely on the memory of the user.

Some mechanisms in the prior art facilitate the saving of a rotational setting of a potentiometer. One example is commercially available as a GUITAR CLUTCH, which allows the saving of a rotational setting by temporarily reducing the rotational range of a potentiometer. Such reduction of the rotational range is caused by the user pushing down on a knob using a push/pull type switch, so that the rotational setting desired by the user becomes a new minimum rotational setting. This causes the potentiometer to be unable to physically rotate past the new minimum setting, once the knob is engaged. Similarly, if the user wants to regain the full rotational range of the potentiometer, then the user must disengage the mechanism, which in turn removes the saved rotational setting.

A need exists for a knob with a potentiometer which retains the full and original functionality of the potentiometer during use, allowing the potentiometer to still rotate within a full range.

Other mechanisms in the prior art have a repositionable knob with a detent for a potentiometer, rheostat, or other settings-based devices. For example, U.S. Pat. No. 3,561,287 describes a mechanism which causes the knob to be more difficult for the user to rotate by the introduction of friction, such as by a disk sandwiched between and simultaneously in contact with a bottom face of a knob on one side and having a spring on another side which applies a force normal to an adjacent face of the disk. Such engagement pushes the disk into contact with the knob, creating friction and a perceptible extra resistance. Accordingly, due to the extra resistance, techniques such as volume swell in a volume-controlling knob become more difficult or even impossible to perform since the knob is more difficult to turn due to such extra resistance.

In addition, in such a mechanism in the prior art, there is no way to remove the detent and to have the potentiometer function normally while installed, and so there is always a detent somewhere in the rotational range of the potentiometer. The mechanism has a thumb screw control located on a knob, with the thumb screw having a position which rotates with the knob. The detent is activated when the disk is coupled to the knob by the thumb screw, which engages the disk axially. In addition, a half detent pair or spring is disposed in the same space, and is secured under a potentiometer nut.

A need exists for a mechanism for a knob with a potentiometer without any perceptible extra resistance to rotational motion.

Another mechanism in the prior art is described in U.S. Pub. No. 2017/0060169 A1, which shows an adjustable detent for an instrument knob in FIG. 5. To set the detent, the user must manually rotate the detent into position. The detent rotates independently and not simultaneously with the control knob, which causes the setting of the control knob to be inconvenient or unintuitive. In addition, the knob is always under frictional force, causing the knob to be more difficult to turn than originally designed before the mechanism was installed. Also, the detent receptable is fixed by a nut, and is only adjustable after loosening the nut of the potentiometer, which is neither convenient, intuitive, nor practical.

A need exists for a detent mechanism of a knob which can be rapidly and easily set and reset.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In an example embodiment, the present invention is a repositionable detent on a component of a control knob, which maintains full original functionality and rotational movement of a potentiometer connected to the control knob.

The component has a tab which acts as a switch and which provides a user with the ability to cause the knob to click into place at any specific desired position within the rotational range of the knob by pushing the tab. Accordingly, every time that the knob rotates past the specific position, the knob clicks into place at that specific position. The user can remove and reset the location of the detent by a flip of the switch, by moving the tab between open and closed states, that is, between first and second setting states.

When the tab is in an open or first setting state, the knob is allowed to rotate normally. When the tab is moved, pressed, or depressed to be in a closed or second setting state, a detent is placed at the current rotational position of the knob. If the knob is rotated any further in either direction, an internal pair of components separate, and the user feels a click, signaling to the user that the user has marked or set the desired rotational position of the knob. When the knob is rotated back past that set position, the knob clicks into place, letting the user know that the knob has arrived back at the position desired by the user.

If the user then pulls the tab into the open or first setting state, the detent is removed and the potentiometer behaves normally, in which the potentiometer freely rotates between a maximum and a minimum setting without encountering any detent. If the switch is again depressed, a detent is again placed at the current position of the knob.

Subsequently, if the user pulls the tab into the open state without the knob being in the position of the detent in which the knob is clicked into place, the user has to simply rotate the knob either to the maximum or minimum settings until the knob again clicks. Then the next time that the tab is moved or depressed, a detent is placed at the position of the knob.

As such, in one aspect, the present invention provides a control knob assembly comprising: a stationary shaft; a rotating shaft operably coupled with a controllable device, the rotating shaft extending from the stationary shaft and rotatably coupled thereto, wherein the rotating shaft and stationary shaft extend through a mounting surface; a base having: a base opening formed by a base lip, a base surface extending radially outward from the base lip, a plurality of stubs extending upwardly from the base surface, and an engaging surface, wherein the base is positioned on the mounting surface with the rotating shaft and stationary shaft extending through the base opening; a fork having: a pair of opposing leg members extending from a body, a fork opening formed between the pair of leg members, a plurality of slot members positioned on the body and leg members for receiving the plurality of stubs, a detent extending upwardly from the body, and a tab extending radially outward from the body, wherein the fork is positioned on the base with the rotating shaft and stationary shaft extending through the fork opening; a gear having: a gear opening, a plurality of teeth positioned on a radially outer section and configured to receive the detent, a limiting member extending radially outward from the radially outer section and positioned thereon, and an upper groove positioned on an upper edge, wherein the gear is positioned on the base surface with the rotating shaft and stationary shaft extending through the gear opening; a fastener having a fastener opening, wherein the fastener is positioned within the gear opening and engaged with the base lip while being fixed to the stationary shaft such that the base is fixed to the mounting surface; and a knob having: a cavity extending longitudinally within an underside of the knob and fixedly engaged to the rotating shaft above the base, fork, gear and nut with the tab extending radially outwardly from underneath the knob, and a biasing member secured on the underside and extending downwardly therefrom, wherein the biasing member is configured to engage the gear upper groove such that when engaged the gear rotates with the knob.

In another aspect, the present invention provides a control knob assembly comprising: a rotating shaft operably coupled with a controllable device, the rotating shaft extending through a mounting surface; a base having a base opening, the base fixed to the mounting surface with the rotating shaft extending through the base opening; a fork having a detent extending upwardly therefrom and a tab extending radially outwardly therefrom, the fork positioned on top of the base and slidably engaged therewith; a gear having a gear opening, a plurality of teeth with the teeth configured to receive the detent, and an upper groove positioned on an upper edge, the gear being positioned on top of the fork with the rotating shaft extending through the gear opening; a knob having a cavity extending longitudinally within an underside of the knob and fixedly engaged to the rotating shaft above the base, fork and gear with the tab extending radially outwardly from underneath the knob; and a biasing member secured on the knob underside and extending downwardly therefrom, wherein the biasing member is configured to engage the gear upper groove such that when engaged the gear rotates with the knob.

In yet another aspect, the present invention provides a method for setting a controllable device to a set position using a control knob assembly, the control knob assembly comprising: a rotating shaft operably coupled with a controllable device, the rotating shaft extending through a mounting surface; a base having a base opening, the base fixed to the mounting surface with the rotating shaft extending through the base opening; a fork having a detent extending upwardly therefrom and a tab extending radially outwardly therefrom, the fork positioned on top of the base and slidably engaged therewith; a gear having a gear opening, a plurality of teeth with the teeth configured to receive the detent, and an upper groove positioned on an upper edge, the gear being positioned on top of the fork with the rotating shaft extending through the gear opening; a knob having a cavity extending longitudinally within an underside of the knob and fixedly engaged to the rotating shaft above the base, fork and gear with the tab extending radially outwardly from underneath the knob; and a biasing member secured on the knob underside and extending downwardly therefrom, wherein the biasing member is configured to engage the gear upper groove such that when engaged the gear rotates with the knob; wherein when the tab is in first position the detent is not engaged with the gear teeth, and when the tab is in a second position the detent is engaged with the gear teeth.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
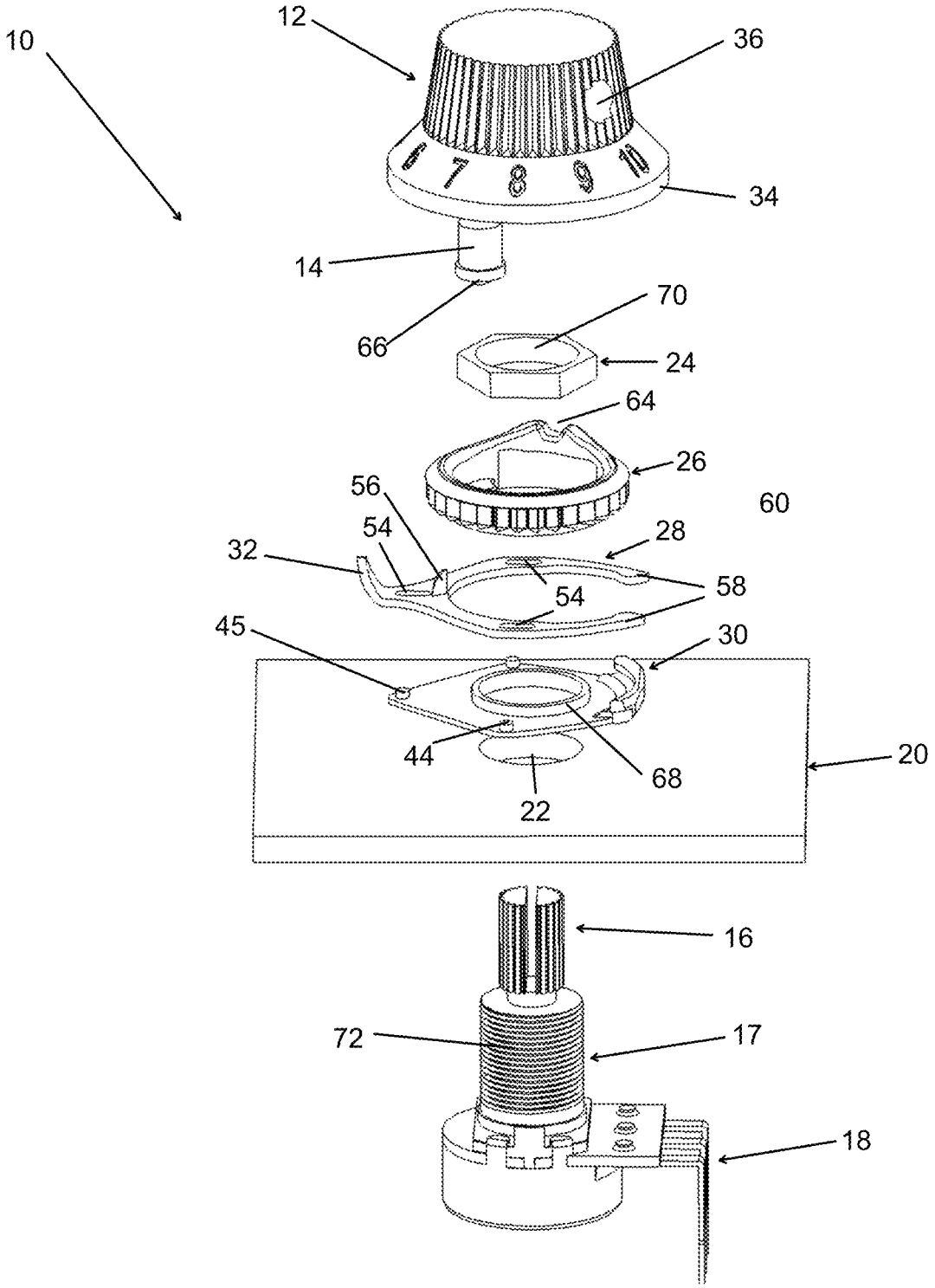
FIG. 1 illustrates a top side perspective view of a control knob assembly or device of the present invention with parts separated.

To facilitate an understanding of the invention, identical reference numerals have been used, when appropriate, to designate the same or similar elements that are common to the figures. Further, unless stated otherwise, the features shown in the figures are not drawn to scale and are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left may be used to describe the accompanying figures. The terminology includes the words above specifically mentioned, derivatives thereof, and words of similar import.

Figure 2:
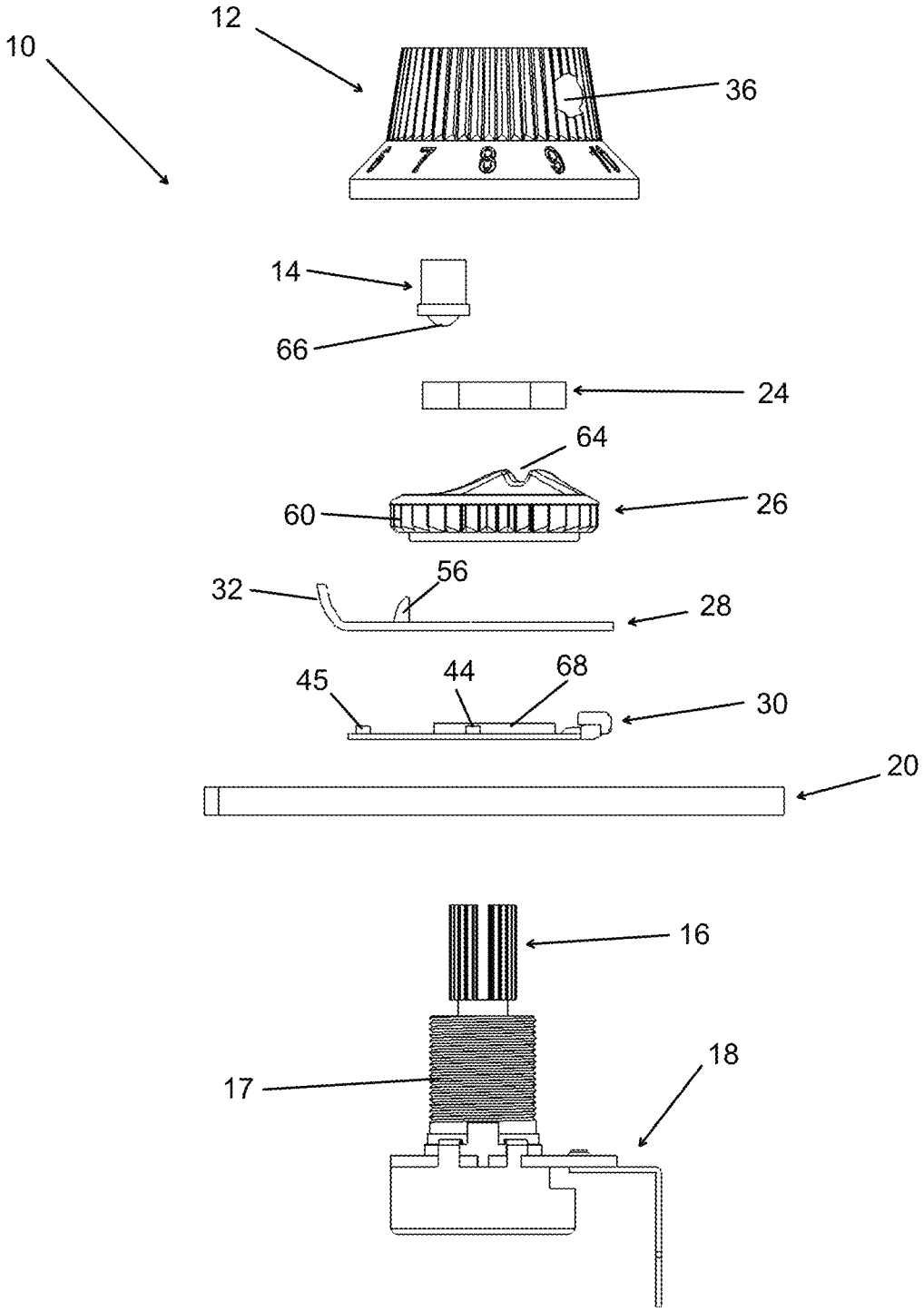
FIG. 2 illustrates a side plan view of the device of FIG. 1 with parts separated.
Figure 3:
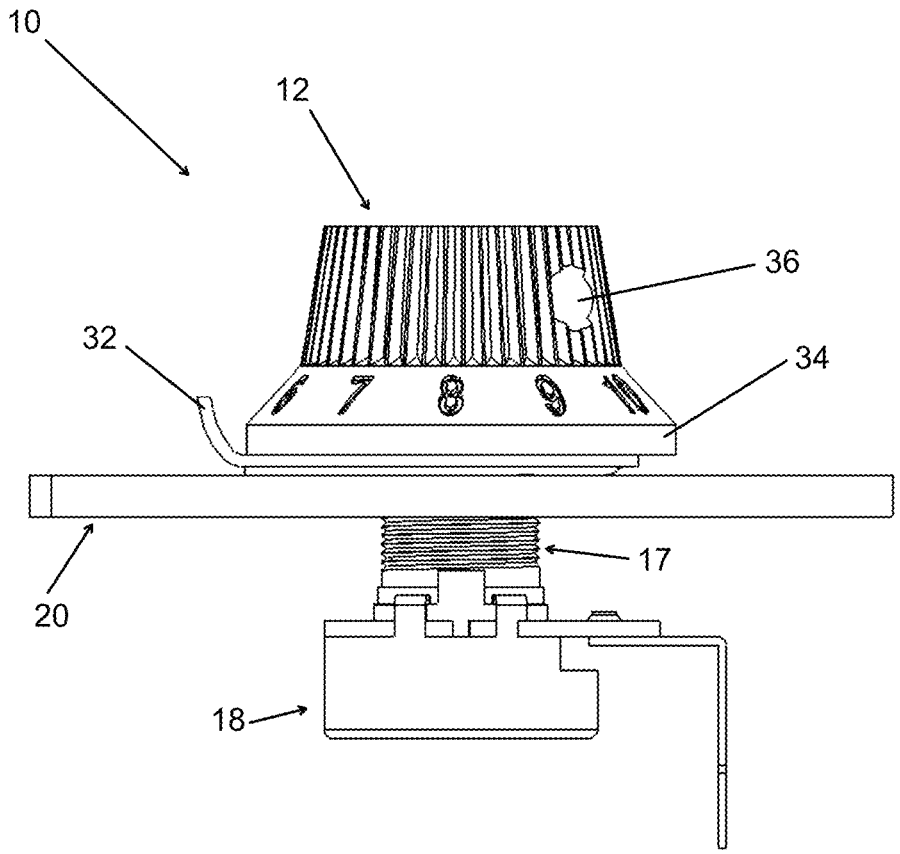
FIG. 3 illustrates a side plan view of the device of FIG. 1 in an assembled configuration.
Figure 4:
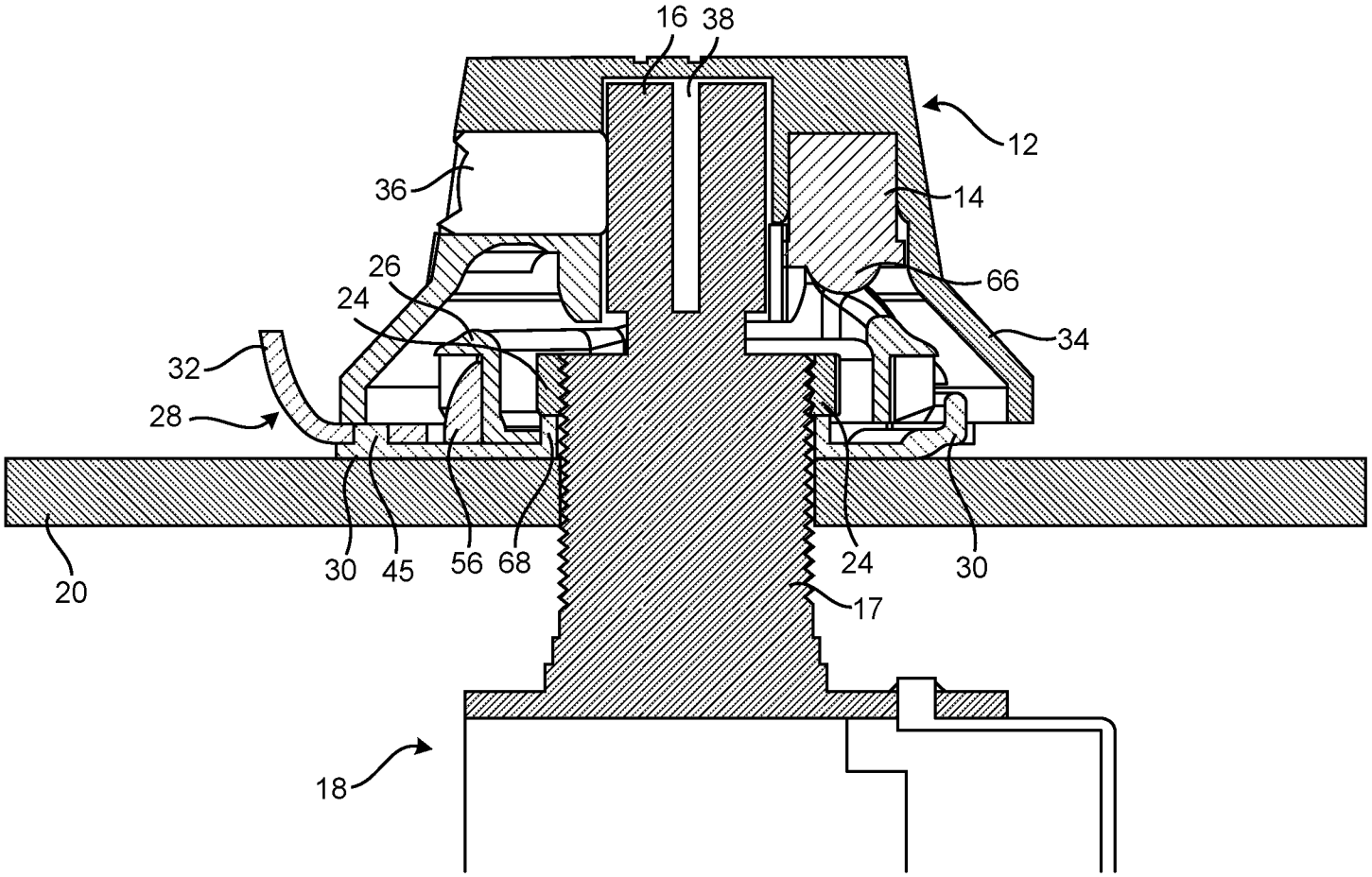
FIG. 4 illustrates a side cross-sectional view of the device of FIG. 3 in a closed or second setting state.

As shown in FIGS. 1-3, a control knob assembly or device 10 of the present invention includes a knob 12 on one side of a mounting surface 20, with the knob 12 coupled to or including a downwardly orientated biasing member or ball spring 14. The knob 12 engages a rotating shaft 16 of a controllable device, e.g., a potentiometer 18, with the body of the potentiometer 18 disposed on an opposing side of the mounting surface 20. The rotating shaft 16 extends through an aperture 22 in the mounting surface 20 and is free to rotate about a central axis of the device 10 with respect to the body of the potentiometer 18. The rotating shaft 16 is positioned above a threaded stationary shaft 17, having threads 72, with the shaft 17 mounted to the body of the potentiometer 18, as shown in FIGS. 1-2 and 4. A fastener, in the form of a threaded nut 24, has threads 70 for engaging the threads 72 of the stationary shaft 17, when the shaft 17 extends through the aperture 22, as shown in FIG. 4.

A gear 26, a fork 28, and a base 30 are disposed between the knob 12 and the mounting surface 20, with the rotating shaft 16 extending through the aperture 22 and through a central region of each of the components 24-30. Referring to FIGS. 1-2 and 4, the threaded nut 24 secures the base 30 to the top side of the mounting surface 20 by having the threads 70 of the nut 24 engage the threads 72 of the stationary shaft 17, as shown in FIG. 4.

A cross-sectional view of the assembled device 10 is shown in FIG. 4, with the base 30 positioned on the mounting surface 20 and having a lip 68 extending upward therefrom, as shown in FIGS. 9-10 and 12-14. The fork 28 rests on the base 30 with leg members 58 of the fork 28 extending around the lip 68. The gear 26 is generally toroidal in shape, and rests on the combination of the fork 28 and the base 30 such that the gear 26 freely rotates about the lip 68. The nut 24 frictionally engages an upper surface of the lip 68 to secure the base 30 to the mounting surface 20 and to prevent rotation of the base 30 about the central axis of the device 10. The maximum diameter of the nut 24 is less than any diameter of the gear 26, such that the nut 24 is positioned within a central portion of the gear 26 and allowing the gear 26 to freely rotate about the central axis of the device 10. As described in greater detail below, the gear 26 only rotates when the ball 66 of the biasing member or ball spring 14 engages the upper groove 64 of the gear 26, which is positioned on an upper edge, as shown in FIGS. 1-2, 16-19, and 21.

Referring to FIGS. 3-4, the device 10 has a tab 32 of the fork 28 extending outward from the bottom rim 34 of the knob 12. Since the leg members 58 extend around the lip 68, the fork 28 is free to move in a linear direction in response to linear movement of the tab 32 while the fork 28 is positioned between the knob 12 and the base 30. The tabs 44, 45 of the base 30 engage respective slots 54 in the fork 28 to constrain the movement of the fork 28 to be linearly directed, as described in greater detail below, and without permitting the fork 28 to rotate about the central axis of the device 10.

The various components such as the knob 12, the gear 26, and the base 30 are composed of plastic, but may alternatively be composed of metal or other rigid materials. The fork 28 is composed of brass, but alternatively may be composed of other metals or rigid materials. It is to be understood that each component can be composed of, but not limited to, any type of metal, plastic, composite material, or any combination of known materials.

Figure 5:
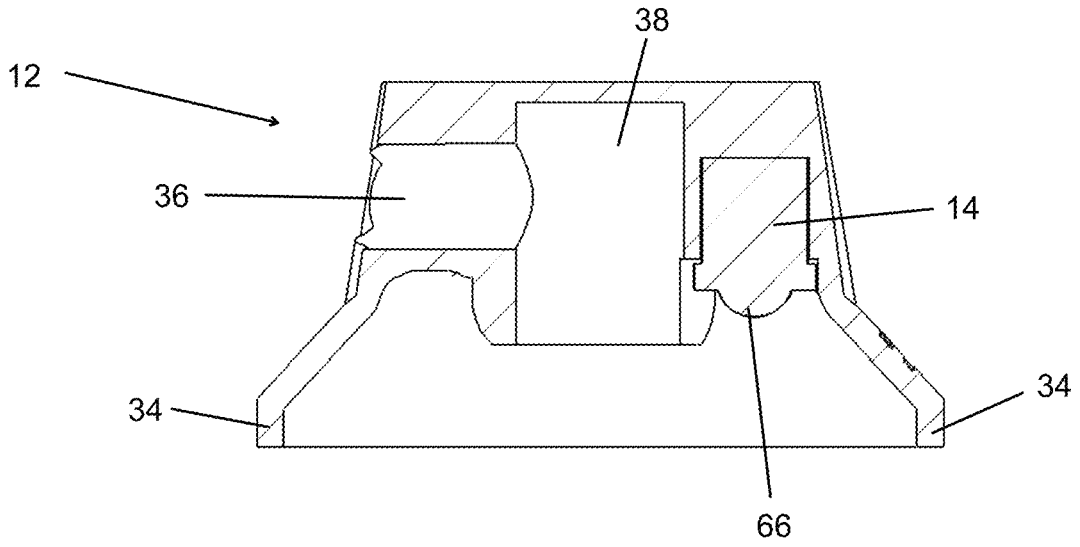
FIG. 5 illustrates a side cross-sectional view of a knob of the device.
Figure 6:
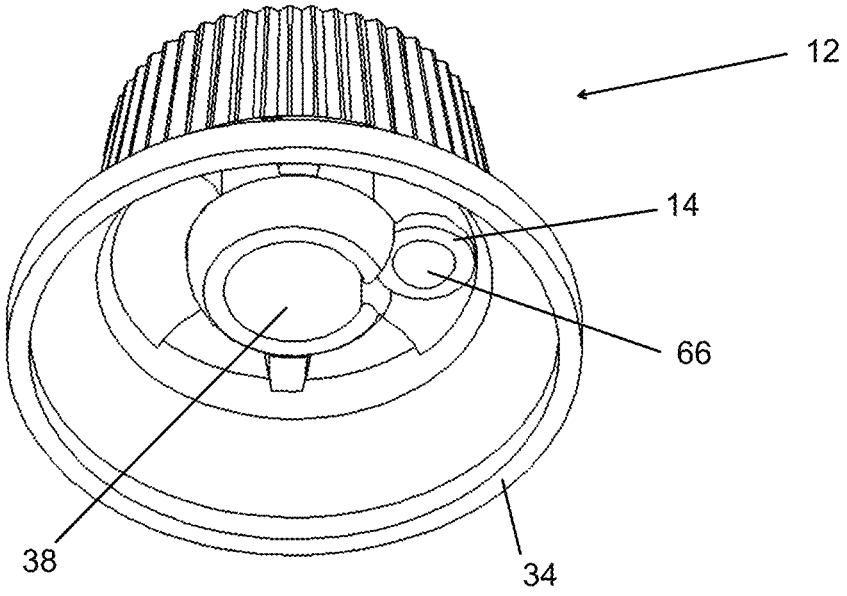
FIG. 6 illustrates a bottom side perspective view of the knob of FIG. 5.

A cross-sectional view of the knob 12 is shown in FIG. 5, and a bottom view of the knob 12 is shown in FIG. 6, with the biasing member or ball spring 14 extending from an underside of the knob 12, having the ball 66 of the ball spring 14 orientated downward to engage an upper groove 64 of the gear 26, as described in greater detail below. As shown in FIGS. 1-5, the knob 12 has a side opening 36 for receiving a screw or other fasteners known in the art to engage and secure the top end of the rotating shaft 16 of the potentiometer 18 to the knob 12, when the top end of the rotating shaft 16 is disposed in a cavity 38 of the knob 12, as shown in FIGS. 5-6. Alternatively, the top end of the rotating shaft 16 may be secured in the cavity 38 by a friction fit, by linear threads, or by other fastening mechanisms known in the art. The ball spring 14 may be any device known in the art with an internally disposed spring allowing a partially exposed ball 66 to retract at least partially into the housing of the ball spring 14 when the internal spring is compressed in response to an upward force on the downwardly orientated ball 66.

Figure 7:
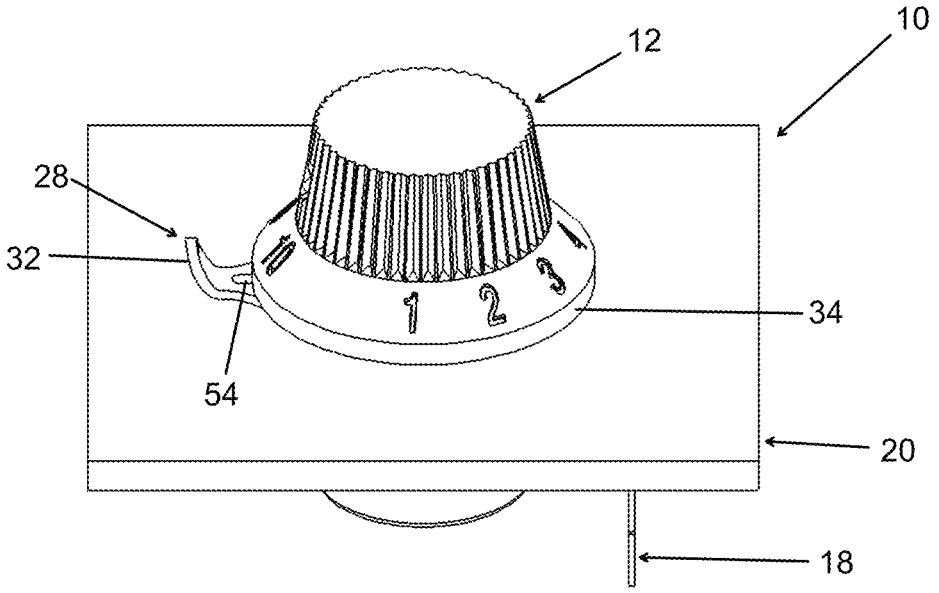
FIG. 7 illustrates a top side perspective view of the device in the assembled configuration in an open or first setting state.
Figure 8:
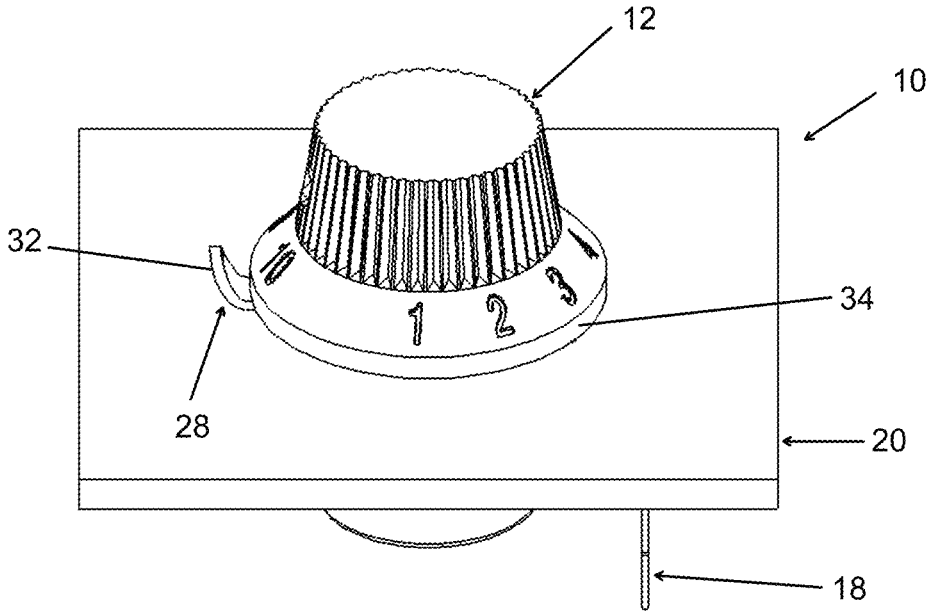
FIG. 8 illustrates a top side perspective view of the device in the assembled configuration in the closed or second setting state.

FIG. 7 illustrates a top side perspective view of the device 10 in the assembled configuration in an open or first setting state, in which the tab 32 of the fork 28 has been pulled linearly outward in a first position. FIG. 8 illustrates a top side perspective view of the device 10 in the assembled configuration in a closed or second setting state, in which the tab 32 has been pushed linearly inward in a second position.

Figure 9:
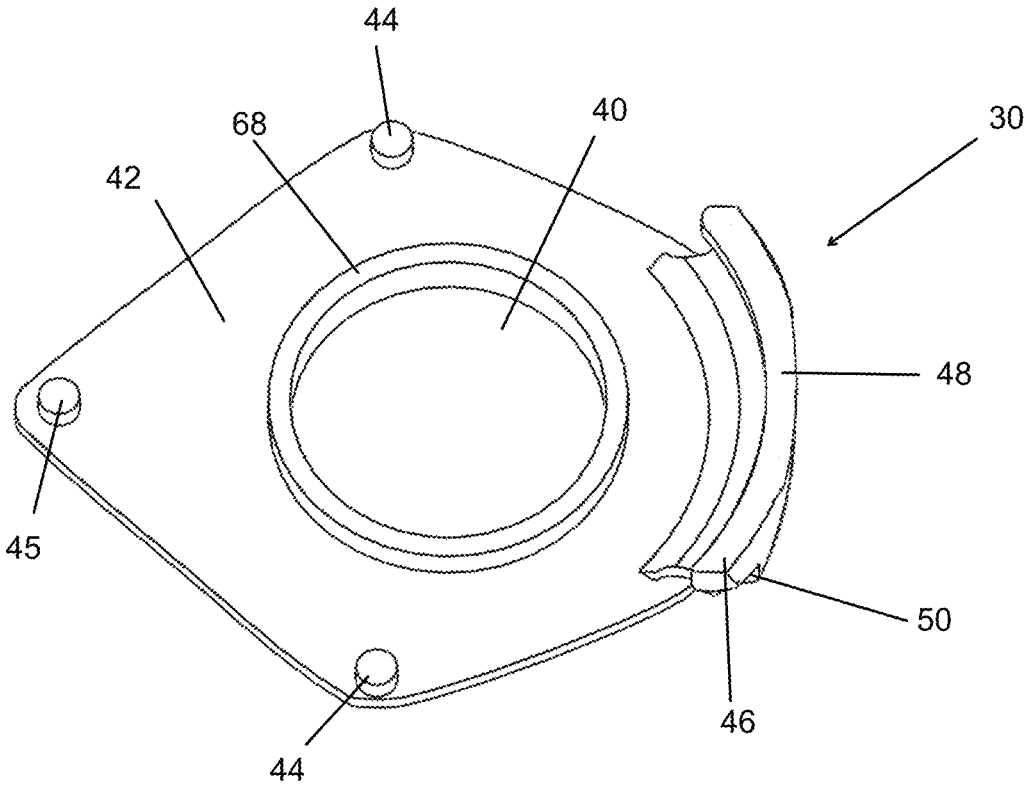
FIG. 9 illustrates a top side perspective view of a base of the device.
Figure 10:
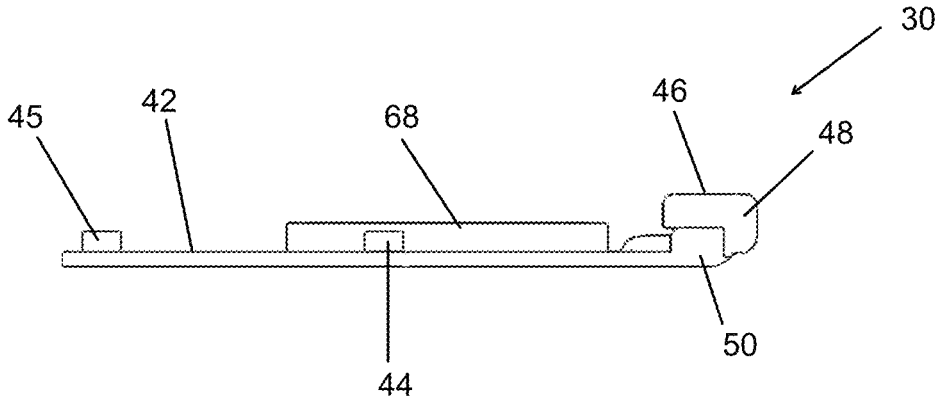
FIG. 10 illustrates a side plan view of the base of FIG. 9.
Figure 11:
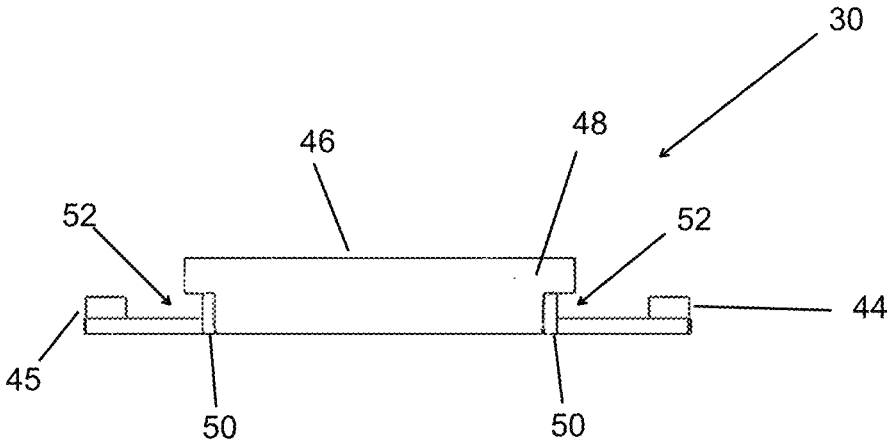
FIG. 11 illustrates a front plan view of the base of FIG. 9.

FIG. 9 illustrates a top side perspective view of the base 30, FIG. 10 illustrates a side plan view of the base 30, and FIG. 11 illustrates a front plan view of the base 30. The base 30 has an opening or central aperture 40 in a surface 42 of the base 30, with the lip 68 extending around the central aperture 40. A plurality of stubs 44, 45, an end member 46, and the lip 68 of the base 30 extend upward from the surface 42. A top portion 48 and walls 50 of the end member 46 form end grooves 52.

Figure 12:
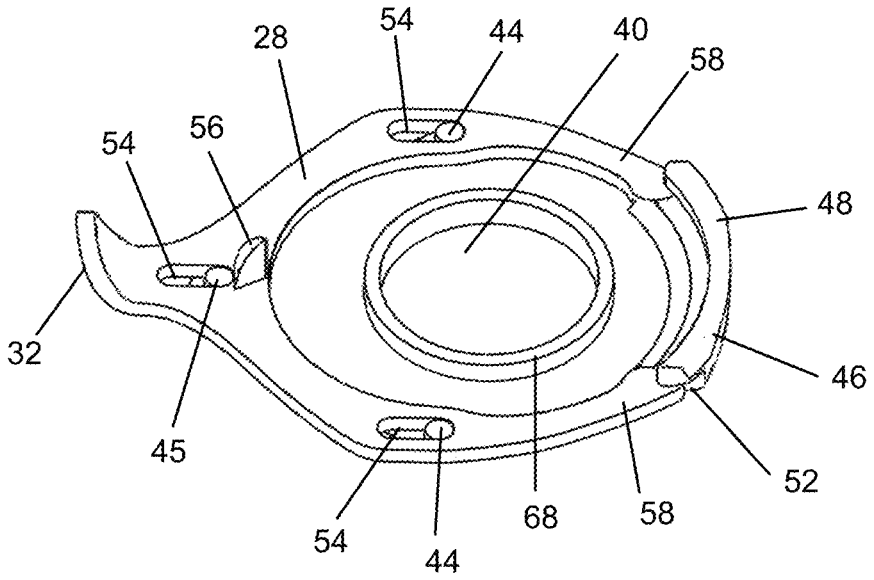
FIG. 12 illustrates a top side perspective view of a fork on the base of the device in the open or first setting state.

FIG. 12 illustrates a top side perspective view of the fork 28 on the base 30 in the open or first setting state, in which the fork 28 has been pulled linearly outward and away from the knob 12 to a first position, as shown in FIG. 7. The fork 28 has slot members or slots 54 in which the stubs 44, 45 are slidably disposed therein, and has a detent 56 extending from a body for engaging teeth 60 of the gear 26, which are disposed on a radially outer section of the gear 26. The fork 28 also includes leg members 58 extending from the body for engaging the grooves 52 of the base 30. An opening is formed between the pair of leg members 58. In the open or first setting state, each stub 44, 45 is disposed in a first end of a respective slot 54.

Figure 13:
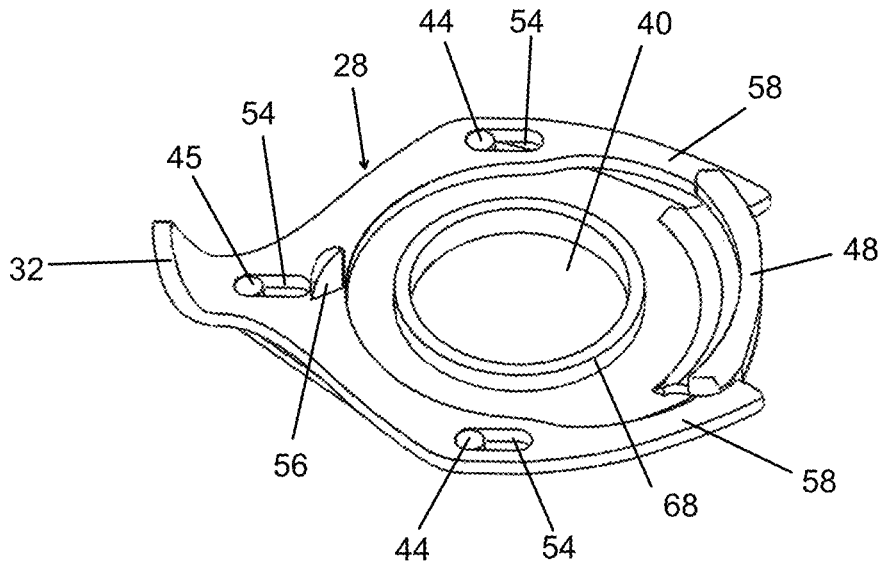
FIG. 13 illustrates a top side perspective view of the fork on the base of the device in the closed or second setting state.
Figure 14:
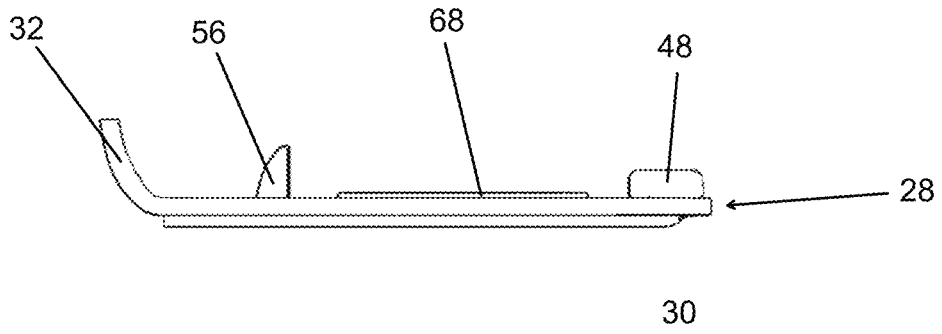
FIG. 14 illustrates a side plan view of the fork on the base in the closed or second setting state.
Figure 15:
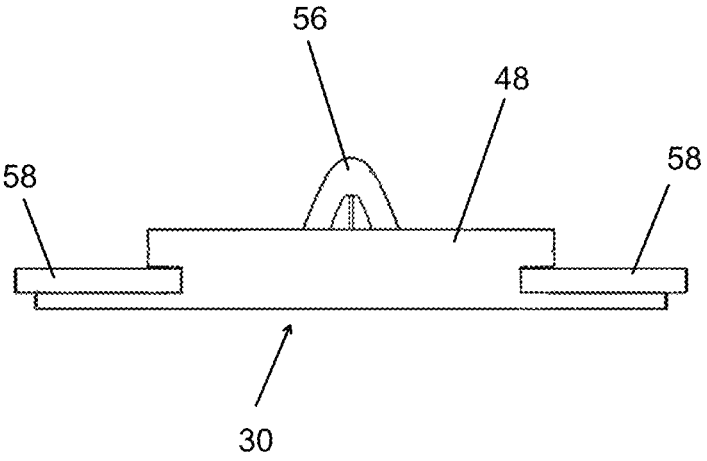
FIG. 15 illustrates a front plan view of the fork on the base.

FIG. 13 illustrates a top side perspective view of the fork 28 positioned on the base 30 of the device 10 in the closed or second setting state, in which the fork 28 has been pushed inward linearly toward the knob 12, as shown in FIG. 8, with each stub 44, 45 disposed in a second, opposite end of its respective slot 54. FIG. 14 illustrates a side plan view of the fork 28 positioned on the base 30 in the closed or second setting state, and FIG. 15 illustrates a front plan view of the fork 28 positioned on the base 30. The fork 28 sits on the base 30 as shown in FIGS. 12-13, with the elongated slots 54 constraining the motion of the fork 28 to move linearly in relation to the base 30. The leg members 58 of the fork 28 act like a spring, and snap into the grooves 52 of the base 30, so the fork 28 behaves like a push/pull switch when moving between the open and closed states; that is, between the first and second setting states, shown in FIG. 7-8 and FIGS. 12-13. The snap-fit engagement of the leg members 58 with the grooves 52 is sufficient to overcome any force generated by the biasing mechanism 14 engaging and disengaging the upper groove 64 when the knob 12 is rotated while the device 10 is in the closed or second state, such that the detent 56 remains engaged with the teeth 60.

Figure 16:
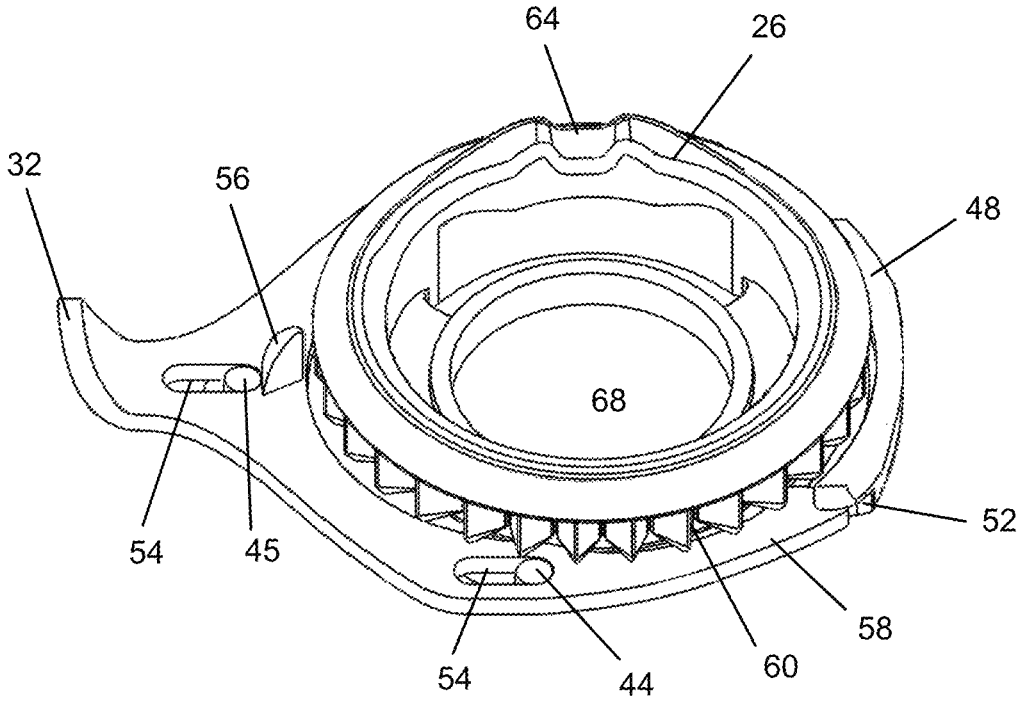
FIG. 16 illustrates a top side perspective view of a gear on the fork and base in the open or first setting state.
Figure 17:
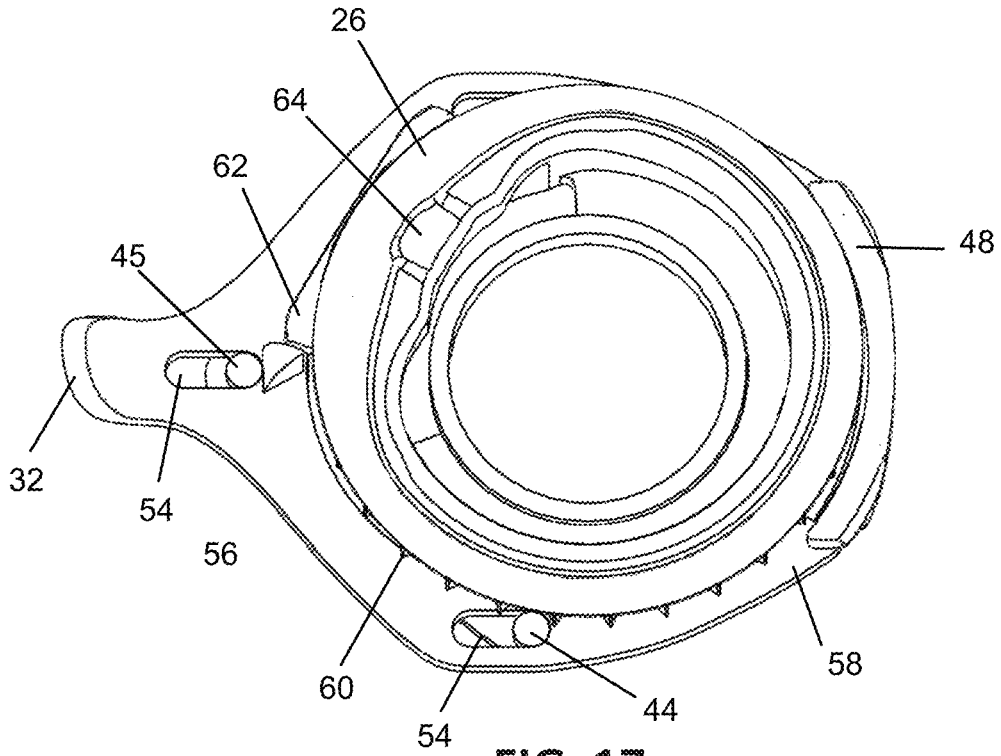
FIG. 17 illustrates a top plan view of the gear, fork, and base assembly of FIG. 16.

FIG. 16 illustrates a top side perspective view of a gear 26 positioned on the combination of the fork 28 and base 30 in the open or first setting state, with the gear 26 in a first rotational position after counterclockwise rotation about the central axis of the device 10. In the open or first setting state, the detent 56 does not engage the teeth 60. FIG. 17 illustrates a top plan view of the gear 26, fork 28, and base 30, with the gear 26 in a second rotational position, such that the detent 56 engages a limiting member 62 of the gear 26, which prevents further counterclockwise rotation of the gear 26. The ball spring 14 and the upper groove 64 form a detent pair, such that when the fork 28 is in the closed or second setting state, as in FIGS. 3-4, 8, 13, and 19, and the knob 12 is rotated away from the detent 56, the detent pair 14, 64 is separated as detent 56 is locked to the teeth 60 and the gear 26 is stationary. Once the user then puts the fork 28 into the open or first setting state, as in FIGS. 7, 12, 16-18, 20 and 21, the ball 66 of the ball spring 14 contacts the upper groove 64 of the gear 26 on an outside edge of the upper groove 64. Thus, the upper groove 64 of the gear 26 moves without the detent formed by the ball spring 66 engaging. If the user continues to rotate the knob 12 to a maximum or minimum rotational position, an outer edge of the gear 26 is then in an extreme position, and the center of the upper groove 64, which catches the ball 66, is pushed outside of the rotational range of the knob 12. Therefore, the upper groove 64 on the gear 26 is not physically engageable by the ball 66 of the ball spring 14, which defeats the function of the knob 12. The rotation limiting features on the gear 26 exist so that the upper groove 64 never occupies a position such that the ball 66 cannot occupy, and vice versa. The gear 26 has the same rotational range as the rotating shaft 16 of the potentiometer 18, regardless of how such functionality is achieved. The same rotational range of the gear 26 and the rotational shaft 16 also prevents further clockwise rotation as well. As such, a user able to reset the device 10 before setting the device 10 to a set position. That is the tab 32 is set to the first position, i.e., the open or first setting state, and the knob 12 is rotated such that the biasing member 14 engages the upper groove 64. Then, the knob 12 further rotated until the limiting member 62 engages the detent 56.

Figure 18:
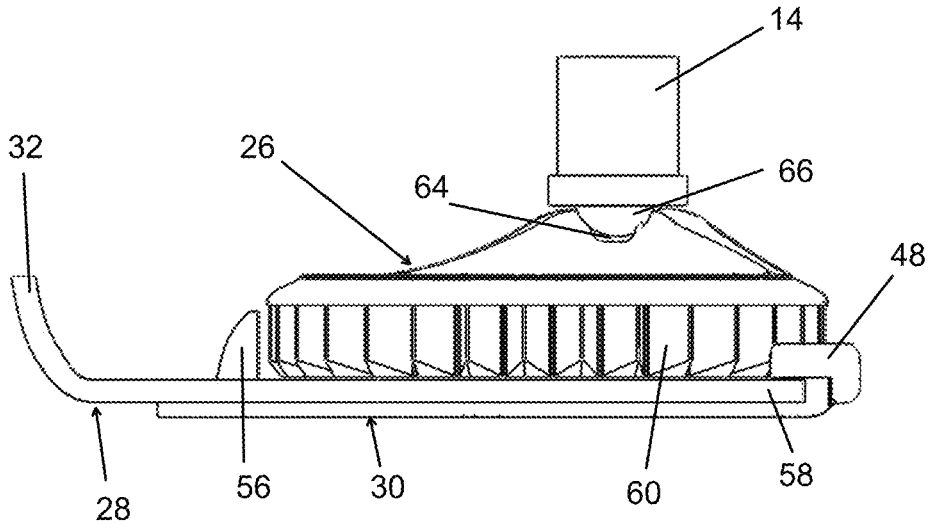
FIG. 18 illustrates a side plan view of the gear, fork, and base assembly of FIG. 16 engaging a ball spring in the first or open setting state.

FIG. 18 illustrates a side plan view of the gear 26, the fork 28, and the base 30, with the gear 26 engaging the ball spring 14 in the open or first setting state, with the detent 56 not engaging the teeth 60 or the limiting member 62. When the gear 26 is rotated such that an upper groove 64 is beneath the ball spring 14, a ball 66 of the ball spring 14 moves downward to engage and sit in the upper groove 64.

Figure 19:
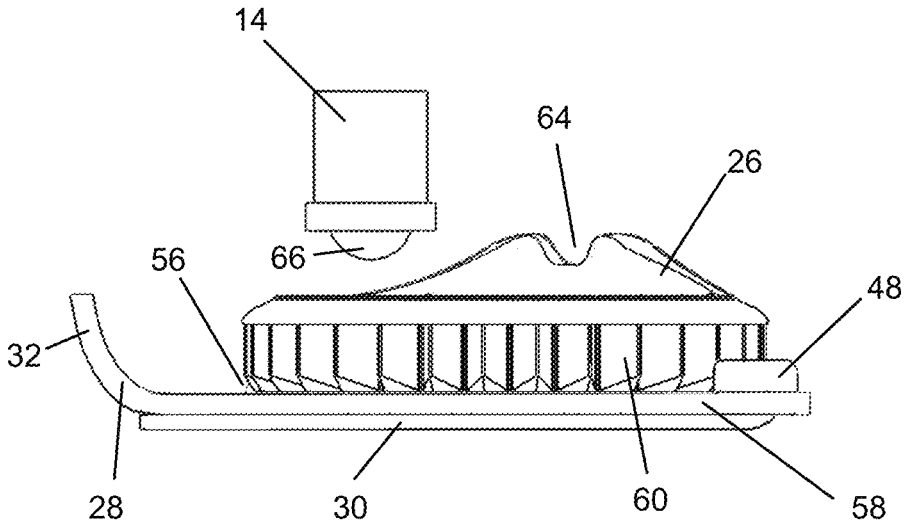
FIG. 19 illustrates a side plan view of the gear, fork, and base assembly in the closed or second setting state and disengaging the ball spring.
Figure 20:
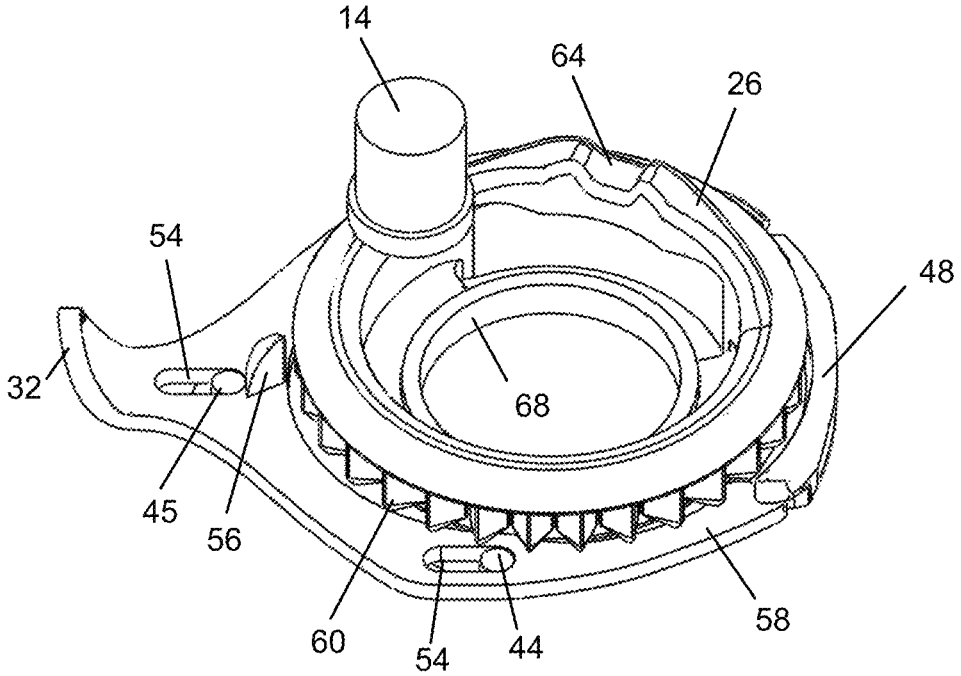
FIG. 20 illustrates a top side perspective view of the gear, fork, and base assembly in the open or first setting state and disengaging the ball spring.
Figure 21:
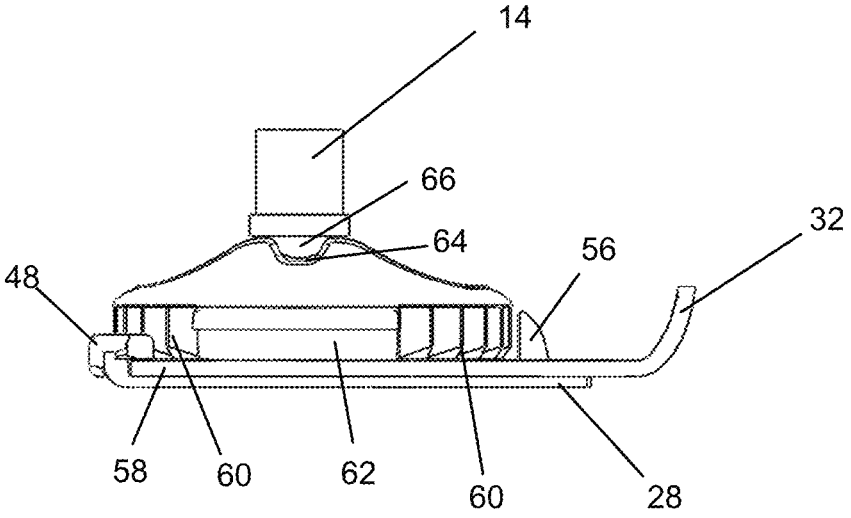
FIG. 21 illustrates another side plan view of the gear, fork, and base assembly in the open or first setting state and engaging the ball spring.

FIG. 19 illustrates a side plan view of the gear 26, the fork 28, and the base 30 in the closed or second setting state, with the gear 26 disengaged from the ball spring 14, and with the detent 56 having moved linearly to engage the teeth 60. FIG. 20 illustrates a top side perspective view of the gear 26, the fork 28, and the base 30 in the open or first setting state with the detent 56 not engaging the teeth 60, and with the ball 66 of the ball spring 14 not engaging the upper groove 64. FIG. 21 illustrates another side plan view of the gear 26, the fork 28, and the base 30, with the gear 26 engaging the ball spring 14, with the tab 32 of the fork in the open or first setting state, in which the detent 56 does not engage the teeth 60.

The gear 26 has rotated the upper groove 64 to be under the ball spring 14 such that the ball 66 engages and sits in the upper groove 64.

As shown in FIGS. 16-21, the gear 26 is allowed to freely rotate when the fork 28 is in the open or first setting state, until the limiting member 62 reaches the detent 56 of the fork 28. The limiting member 62 of the gear 26 then contacts the detent 56, as shown in FIG. 17, constraining the rotational range of the gear 26, which has the same rotational range of the shaft 16 of the potentiometer 18.

With the fork 28 in the open or first setting state, when the ball 66 of the ball spring 14 is captured by the upper groove 64 of the gear 26, the knob 12 and the gear 26 rotate together. With the fork 28 in the closed or second setting state, the detent 56 on the fork 28 meshes with the teeth 60 of the gear 26, as shown in FIG. 19, and the gear 26 can no longer rotate. Therefore, the position of the upper groove 64 is fixed, and any further rotation of the knob 12 causes the ball 66 of the ball spring 14 to disengage the upper groove 64, such that the user touching the knob 12 feels a click. Such a click also occurs when the knob 12 is rotated back and the ball 66 of the ball spring 14 re-enters the upper groove 64. If the user then pulls the tab 32 of the fork 28 to a first position to position the fork 28 in the open or first setting state, the gear 26 is allowed to resume rotating in unison with the knob 12, therefore allowing the user to place, replace, or remove the detent 56 to engage the teeth 60 anywhere with a flip of a switch, embodied as linear movement of the tab 32 relative to the gear 26. With the fork 28 and its tab 32 pulled out to the open or first setting state while the ball 66 of the ball spring 14 is disengaged from the upper groove 65, the device 10 cannot reset until the ball 66 of the ball spring 14 and the upper groove 64 of the gear 26 are engaged again.

For resetting the device 10, if the user pulls the tab 32 to a first position and into the open or first setting state, as shown in FIG. 7, without the ball spring 14 of the knob 12 being in the position of the upper groove 64, the ball 66 of the ball spring 14 pushes and rotates the gear 26 by the ball 66 contacting the outside of the upper groove 64. Then the user simply rotates the knob 12 to either rotational extreme, such as a maximum setting or a minimum setting, until the ball 66 of the ball spring 14 again clicks into place in the upper groove 64. The next time that the tab 32 is depressed to a second position; that is, pushed linearly inward to be in the closed or second setting state, as shown in FIG. 8, the upper groove 64 is placed at the rotational position of the knob 12 and its associated ball 66 of the ball spring 14.

Accordingly, the device 10 of the present invention retains the full, original functionality and rotational movement of the shaft 16 of the potentiometer 18 during use. Therefore, the knob 12 and the attached shaft 16 can still rotate within a full range of the potentiometer 18, with a click felt and/or heard somewhere within the full rotational range when the ball 66 is engaged with the upper groove 64 of the gear 26. Accordingly, when the detent 56 is set, i.e., second position of the tab 32, and the ball 66 is not engaged with the upper groove 64 of the gear 26, the knob 12 rotates freely and unencumbered in either of the two regions; that is, between the detent 56 and the maximum setting of the knob 12, and the detent 56 and the minimum setting of the knob 12. However, when the detent 56 is disengaged from the teeth 60 of the gear 26, i.e., the first position of the tab 32, the potentiometer 18 functions normally, such that the shaft 16 rotates normally and unencumbered without encountering any clicks or detents.

In addition, the rotation of the knob 12 and the potentiometer 18 do not have any perceptible extra resistance, which preserves the feel and free rotation of the knob 12 and the potentiometer 18. Such a free rotation capability of the knob 12 permits volume swell and other audio techniques to be performed when the knob 12 acts as a volume control knob. Furthermore, unlike the prior art, the device 10 of the present invention allows the detent 56 to be removed from the teeth 60 and/or from the limiting member 62 obstructing the rotational motion of the gear 26, and so the potentiometer 18 is always capable of functioning normally. Also, the push/pull operation of the tab 32 to engage or disengage the detent 56 from the teeth 60 of the gear 26 provides for convenient and intuitive operation of the device 10 to control the rotation of the knob 12 and/or the potentiometer 18, as opposed to a thumb screw type of control knob in the prior art. In addition, the control interface of the device 10, in the form of the linearly movable tab 32, is located in a fixed location under the bottom rim 34 of the knob 12, and so the tab 32 is conveniently fixed and accessible, unlike control interfaces in the prior art which are located on the knob, and so have a position which rotates as the knob in the prior art rotates.

The device 10 of the present invention is also advantageous by having the gear 26 decoupled from the knob 12, and only engaging the knob 12 when the ball spring 14, attached to the knob 12, has the ball 66 disposed in the upper groove 64 of the gear 26. Such decoupling of the gear 26 from the knob 12 allows the detent 56 to be removably coupled to the gear 26 radially by engaging the teeth 60 when the tab 32 is moved linearly relative to the base 30 and the gear 26. On the contrary, knobs with detent mechanisms in the prior art engage, in an axial arrangement, a disk or other rotational component, and so the disk is coupled to the knob and lacks the freedom of the disk in the prior art to rotate independent of the knob.

In addition, the device 10 of the present invention has the tab 32, as a pull/push switch, incorporated into the fork 28 which engages the base 30 via the stubs 44, 45 constrained to move in respective slots 54, with only the base 30 secured to the mounting surface 20 by the nut 24. Thus, the device 10 has the fork 28 maintaining the freedom to be linearly moved to activate or deactivate the setting of the detent 56 to engage the teeth 60 and/or to be in the rotational path of the limiting member 62 of the gear 26. Accordingly, the nut 24 secures the base 30 to the potentiometer 18, but the nut 24 does not interfere with operation of the tab 32 and the setting of the detent 56 in the teeth 60. However, knobs with detent mechanisms in the prior art have detents or springs which inhabit the same space and are secured under a nut to the potentiometer in the prior art, and so rotational motion of the detents or springs is limited.

Figure 22:
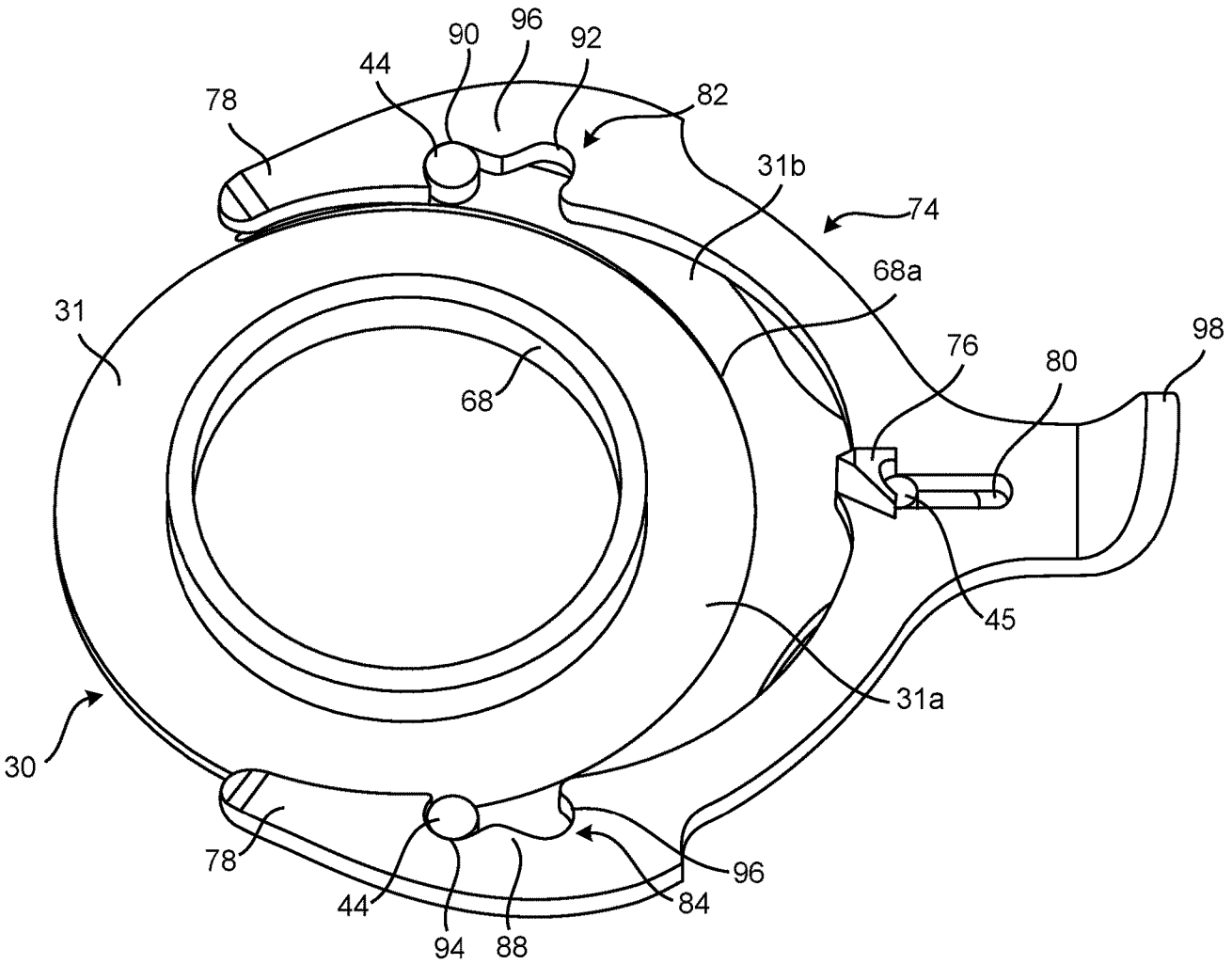
FIG. 22 illustrates a top side perspective view of alternative embodiments of a fork and base of the device of the present invention.

FIG. 22 shows alternative embodiments of a fork 74 and base 31. For purposes of clarity, the fork 74 and base 31 are used in the device 10 in combination with the other components of the device 10 shown and described herein. In this embodiment, the fork 74 has a detent 76 extending from a body and flexible leg members 78. An opening is formed between the pair of leg members 78. As in the fork 28 of the previous embodiment, the fork 74 in the alternative embodiment has a slot member in the form of an elongated slot 80 disposed on a body within which a stub 45 of the base 31 moves linearly, and so constraining the fork 74 to linear motion in response to linear movement of the tab 98. However, in this embodiment, the leg members 78 of the fork 74, which extend from the body, has curved surfaces 82, 84 with cusps 86, 88, respectively, which form slot members in the form of grooved engagements or curved slots 90, 92, 94, 96 on either side of respective cusps 86, 88. Stubs 44 on the base 30 are disposed in respective curved slots 90, 92, 94, 96, with the cusps 86, 88, respectively, preventing linear movement of the stubs 44 until sufficient linear force is applied to the tab 98. Such linear force causes the leg members 78 to part slightly as the stubs 44 make contact with the cusps 86, 88, allowing the stubs 44 to move from the curved slots 90, 94 to the adjacent curved slots 92, 96, and vice versa, depending on the direction of linear movement of the tab 98. As such, the device 10 is maintained in either the open or closed states as desired. Importantly, the device 10 is maintained in the closed state when desired because the force necessary to move the fork 74 from one state to the other, i.e., to move the stubs 44 past the cusps 86, 88, is greater than any force generated by the biasing mechanism 14 engaging and disengaging the upper groove 64 when the knob 12 is rotated while the device 10 is in the closed or second state, such that the detent 56 remains engaged with the teeth 60. Due to this feature, the base end member 46 shown in the previous embodiment (see, e.g., FIG. 12) is eliminated.

Still referring to FIG. 22, the base 31 includes a central portion 31*a* having a substantially circular lip 68 extending upwardly, and an engaging surface 31*b* extending partially radially outward from the central portion 31*a*, to form an outer lip 68*a* between the central portion 31*a* and the engaging surface 31*b*. The engaging surface 31*a* extends laterally from the outer lip 68*a* with the stub 45 extending upwardly therefrom. As well, the engaging surface 31*a* extends radially outward from the outer lip 68*a* partially around the central portion 31*a* while the stubs 44 extend therefrom opposite each other.

As shown in FIG. 22, distal ends of the leg member 78 are configured such that radially inner surfaces are shaped substantially similar to a shape of an outer surface of the outer lip 68*a*. Furthermore, the outer lip 68*a* is configured to have a depth sufficient for the leg members 78 to be guided when linear movement occurs during operation. With such a configuration, the stub 45 is relieved of additional stress when the user pulls the tab 98 to the open or first setting state, or first position of the tab 98, as shown in FIG. 22, because engagement of the distal ends of the leg member 78 with the outer lip 68*a* provides the additional stress to be distributed thereto.

FIGS. 23-30 show further alternative embodiments of the fork 174 and base 131 of the present invention. For purposes of clarity, the fork 174 and base 131 are used in the device 10 in combination with the other components of the device 10 shown and described herein. As described in more detail below, the fork 174 and base 131 in this embodiment include additional inventive features for minimizing or even eliminating vertical displacement between the fork 174 and base 131. As with the previous embodiments, in this embodiment, the fork 174 has a detent 176 extending upwardly from a body, flexible leg members 178 extending laterally from the body. A slot member in the form of an elongated slot 180 is disposed on the body within which a stub 145 of the base 131 moves linearly in a lateral direction, to constrain the fork 174 to linear motion in response to linear movement of the tab 198. An opening is formed between the pair of leg members 178.

The fork 174 includes curved surfaces 182, 184 with cusps 186, 188, respectively, which form additional slot members in the form of grooved engagements or curved slots 190, 192, 194, 196 on either side of respective cusps 186, 188. Stubs 144 on the base 131 are disposed in respective curved slots 190, 192, 194, 196, with the cusps 186, 188, respectively, preventing linear movement of the stubs 144 until sufficient linear force is applied to the tab 198. Such linear force causes the leg members 178 to part slightly, allowing the stubs 144 to move from the curved slots 190, 194 to adjacent curved slots 192, 196, and vice versa, depending on the direction of linear movement of the tab 198. As such, the device 10 is maintained in either the open or closed states as desired. Importantly, the device 10 is maintained in the closed state when desired because the force necessary to move the fork 174 from one state to the other, i.e., to move the stubs 144 past the cusps 186, 188, is greater than any force generated by the biasing mechanism 14 engaging and disengaging the upper groove 64 when the knob 12 is rotated while the device 10 is in the closed or second state, such that the detent 56 remains engaged with the teeth 60. Due to this feature, the base end member 46 shown in the earlier embodiment (see, e.g., FIG. 12) is eliminated.

Figure 25:
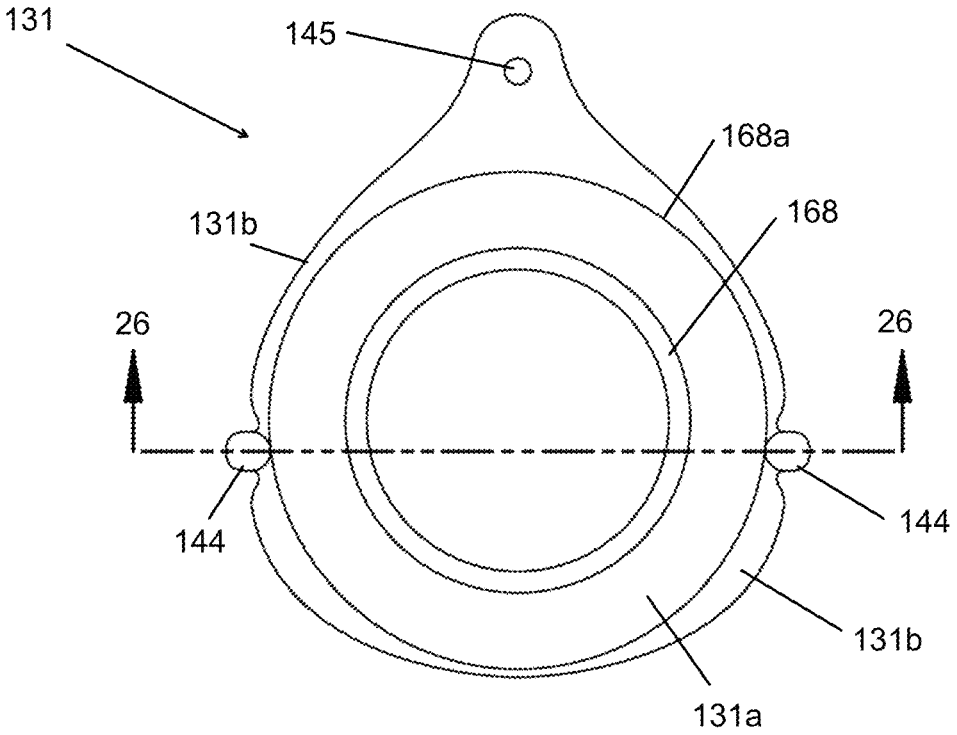
FIGS. 25-27 illustrate another embodiment of a base of the device of the present invention with FIGS. 26 and 27 being sectional views of FIG. 25.
Figure 26:
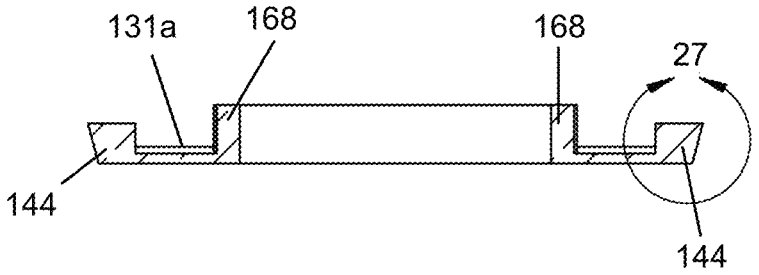
Figure 27:
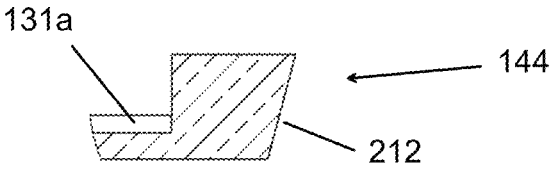

As shown in FIGS. 25-27, the base 131 includes a central portion 131*a* having a substantially circular lip 168 extending upwardly, and an engaging surface 131*b* extending partially radially outward from the central portion 131*a*, to form an outer lip 168*a* between the central portion 131*a* and the engaging surface 131*b*. The engaging surface 131*a* extends laterally in one direction from the outer lip 168*a* with the stub 145 extending upwardly therefrom. As well, the engaging surface 131*a* extends radially outward from the outer lip 168*a* partially around the central portion 131*a* while the stubs 144 extend therefrom on opposite each other.

Figure 28:
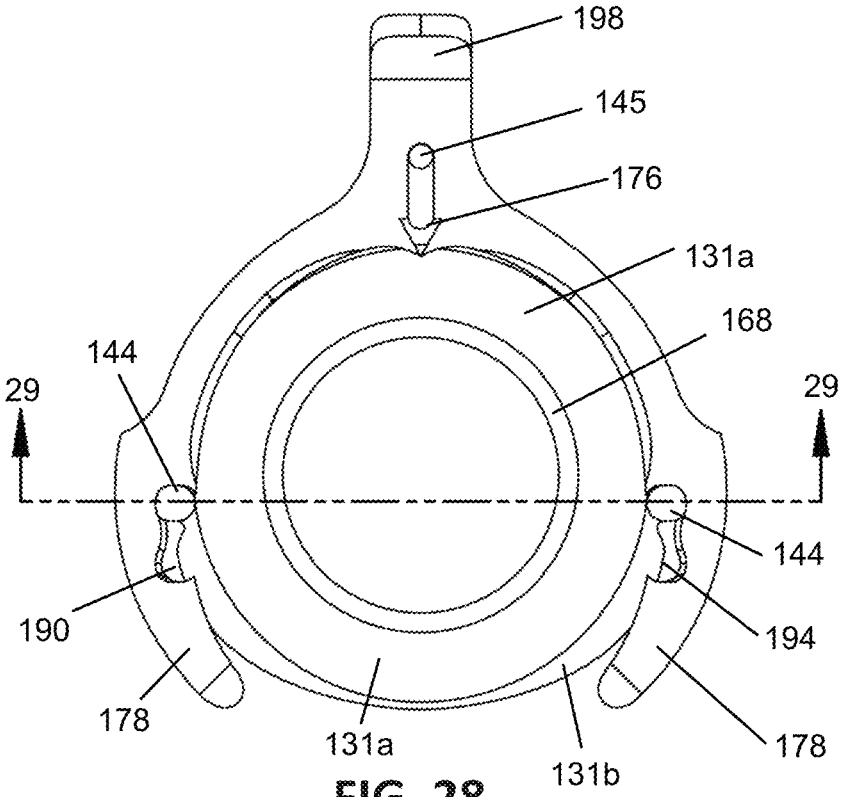
FIGS. 28-30 illustrate the fork of FIG. 23 engaged with the base of FIG. 25 with FIGS. 29 and 30 being sectional views of FIG. 28.

As shown in FIG. 28, distal ends of the leg members 178 are configured such that radially inner surfaces are shaped substantially similar to a shape of an outer surface of the outer lip 168*a*. Furthermore, the outer lip 168*a* is configured to have a depth sufficient for the leg members 178 to be guided when linear movement occurs during operation. With such a configuration, the stubs 144, 145 are relieved of additional stress when the user pulls the tab 198 to a closed or second setting state as shown, for example in FIG. 22, because engagement of the distal ends of the leg member 178 with the outer lip 168*a* provides the additional stress to be distributed thereto.

Figure 23:
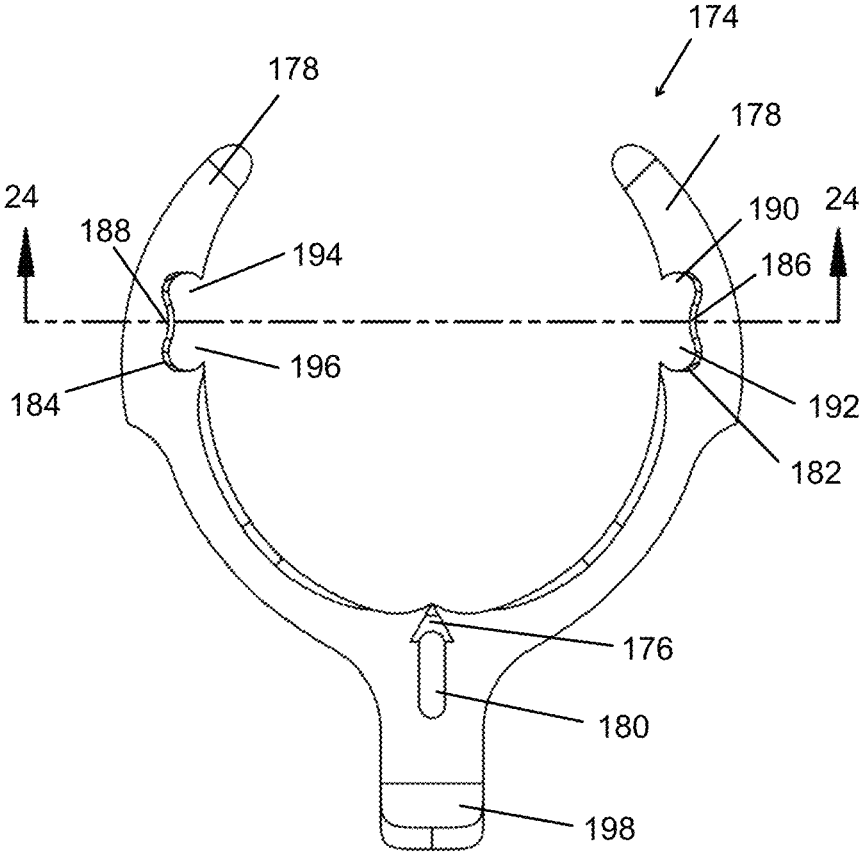
FIGS. 23-24 illustrate another embodiment of a fork of the device of the present invention with FIG. 24 being a partial section view of FIG. 23.
Figure 24:
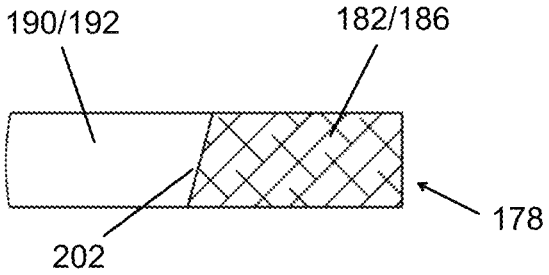

Referring to FIGS. 23 and 24, while inner surfaces 202 of the cusps 182-188 and slots 190-196 of the fork 174 are flat, i.e., linear cross-section, the inner surfaces 202 are not perpendicular to a top or bottom surface of the fork 174. Instead, as shown in FIG. 24, the inner surfaces 202 are at an acute angle relative to the bottom surface of the fork 174.

Referring to FIGS. 25-27, while the radially outer surfaces 212 of the side stubs 144 of the base 131 are flat, i.e., linear cross-section, the radially outer surfaces 212 are not perpendicular to a top or bottom surface of the side stubs 144. Instead, as shown in FIGS. 26 and 27, the outer surfaces 212 are at an obtuse angle relative to the bottom surface of the side stubs 144. Moreover, the angle of the outer surfaces 212 and the angle of the inner surfaces 202 are supplementary when added, i.e., the inner surfaces 202 and outer surfaces 212 are parallel to each other.

Figure 29:
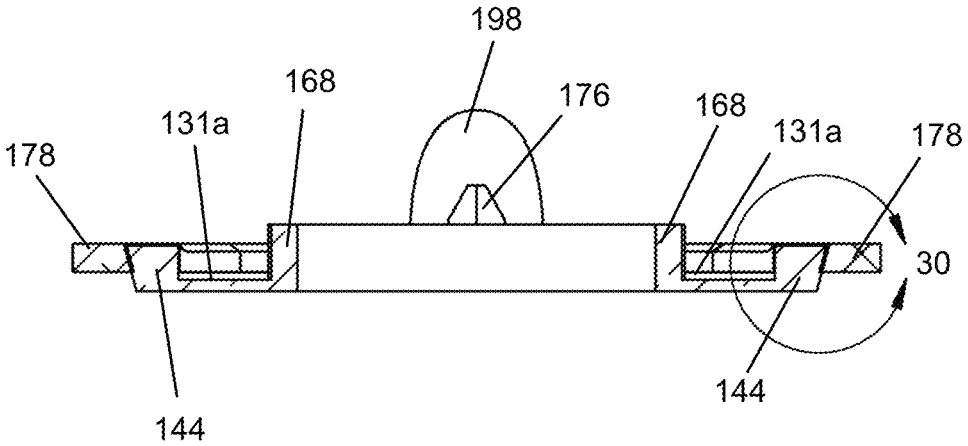
Figure 30:
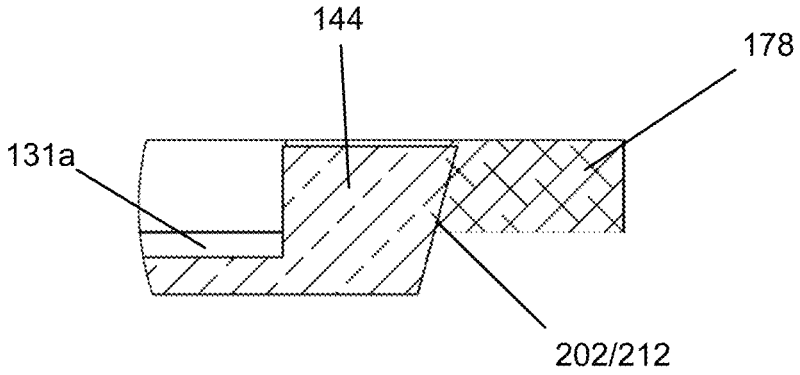

Now referring to FIGS. 28-30, which shows the fork 174 and base 131 in the open or first setting state with the tab 198 in a first position, when the fork 174 and base 131 are engaged the inner surfaces 202 of the fork leg members 178 are in full contact with the outer surfaces 212 of the side stubs 145. As such, the fork 174 and base 131 are configured to minimize or even eliminate vertical displacement between the fork 174 and base 131.

The device 10 of the present invention is not necessarily limited to a ball spring 14 with a ball 66 which engages the upper groove 64. Instead, in an alternative embodiment, the device 10 may employ a strip of metal which deflects, instead of the ball 66 of the ball spring 14. Alternatively, the device 10 can use a magnet, a stamped piece of sheet metal forming a spring to engage the upper groove 64, or any pair of components or features that can provide tactile feedback and resistance during rotation of the knob when engaged, but which does not completely interrupt or suspend rotation of the knob.

In further alternative embodiments, the rotation of the gear 26 can be stopped in other ways, such as with components engaging each other and being constrained in movement via magnets. Alternatively, a band disposed around the gear 26 may be configured to be pulled tight by linear motion of the tab 32, which stops rotation of the gear 26. In another alternative embodiment, a pad may be moved by linear motion of the tab 32, such that the pad is compressed against the gear 26 like a brake, resulting in sufficient friction to prevent rotation of the gear 26.

An additional alternative apparatus may include any device which consists of a detent pair, in which one component of the detent pair is positioned on an independently rotating disk, and the other component of the detent pair is on the knob, such that the disk and knob rotate concentrically. Rotation of the knob and disk can be coupled by the detent itself and stopping the disk from rotating sets the position of the detent. A push/pull switch, a button, a lever, etc. can be used to stop the disk from rotating.

The present invention may be embodied in other specific forms without departing from its spirit or essential characteristics. The control knob assembly of the present invention could be used on a variety of applications pertaining to controllable devices. For example, in addition to setting volume levels on speakers and amplifiers, the control knob assembly of the present invention could be used for lighting fixtures, cooling and heating units, and home appliances.

Therefore, the described embodiments are to be considered in all respects only as illustrative and not restrictive. The scope of the invention, therefore, will be indicated by claims rather than by the foregoing description. All changes, which come within the meaning and range of equivalency of the claims, are to be embraced within their scope.

The invention claimed is:

1. A control knob assembly comprising:

a stationary shaft;

a rotating shaft operably coupled with a controllable device, the rotating shaft extending from the stationary shaft and rotatably coupled thereto, wherein the rotating shaft and stationary shaft extend through a mounting surface;

a base having: a base opening formed by a base lip, a base surface extending radially outward from the base lip, a plurality of stubs extending upwardly from the base surface, and an engaging surface, wherein the base is positioned on the mounting surface with the rotating shaft and stationary shaft extending through the base opening;

a fork having: a pair of opposing leg members extending from a body, a fork opening formed between the pair of leg members, a plurality of slot members positioned on the body and leg members for receiving the plurality of stubs, a detent extending upwardly from the body, and a tab extending radially outward from the body, wherein the fork is positioned on the base with the rotating shaft and stationary shaft extending through the fork opening;

a gear having: a gear opening, a plurality of teeth positioned on a radially outer section and configured to receive the detent, a limiting member extending radially outward from the radially outer section and positioned thereon, and an upper groove positioned on an upper edge, wherein the gear is positioned on the base surface with the rotating shaft and stationary shaft extending through the gear opening;

a fastener having a fastener opening, wherein the fastener is positioned within the gear opening and engaged with the base lip while being fixed to the stationary shaft such that the base is fixed to the mounting surface; and a knob having: a cavity extending longitudinally within an underside of the knob and fixedly engaged to the rotating shaft above the base, fork, and gear with the tab extending radially outwardly from underneath the knob, and a biasing member secured on the underside and extending downwardly therefrom, wherein the biasing member is configured to engage the gear upper groove such that when engaged the gear rotates with the knob.

2. The control knob assembly of claim 1, wherein in an open state, the tab is in a first position and the gear rotates with the knob only when the biasing member engages the upper groove.

3. The control knob assembly of claim 2, wherein in a closed state, the tab is in a second position such that the detent engages the teeth thereby preventing the gear from rotating while the biasing member is capable of disengaging the upper groove and rotating with the knob, a set position defined by a position of the gear in the closed state.

4. The control knob assembly of claim 3, wherein the knob is returned to the set position when the biasing member re-engages the upper groove while in the closed state.

5. The control knob assembly of claim 1, wherein each slot member is an elongated aperture enclosed on the fork such that corresponding stubs are movable therewithin between an open state and a closed state defined by a position of the tab.

6. The control knob assembly of claim 1, wherein each slot member on the leg members includes a pair of adjacent grooved engagements formed thereon such that corresponding stubs are movable from one groove engagement to another groove engagement between an open state and a closed state defined by the position of the tab.

7. A control knob assembly comprising:

a rotating shaft operably coupled with a controllable device, the rotating shaft extending through a mounting surface;

a base having a base opening, the base fixed to the mounting surface with the rotating shaft extending through the base opening;

a fork having a detent extending upwardly therefrom and a tab extending radially outwardly therefrom, the fork positioned on top of the base and slidably engaged therewith;

a gear having a gear opening, a plurality of teeth with the teeth configured to receive the detent, and an upper groove positioned on an upper edge, the gear being positioned on top of the fork with the rotating shaft extending through the gear opening;

a knob having a cavity extending longitudinally within an underside of the knob and fixedly engaged to the rotating shaft above the base, fork and gear with the tab extending radially outwardly from underneath the knob; and a biasing member secured on the knob underside and extending downwardly therefrom, wherein the biasing member is configured to engage the gear upper groove such that when engaged the gear rotates with the knob.

8. The control knob assembly of claim 7, wherein in an open state, the tab is in a first position and the gear rotates with the knob only when the biasing member engages the upper groove.

9. The control knob assembly of claim 8, wherein in a closed state, the tab is in a second position such that the detent engages the teeth thereby preventing the gear from rotating while the biasing member is capable of disengaging the upper groove and rotating with the knob, a set position defined by a position of the gear in the closed state.

10. The control knob assembly of claim 9, wherein the knob is returned to the set position when the biasing member re-engages the upper groove while in the closed state.

11. The control knob assembly of claim 7, wherein the base further comprises a plurality of stubs extending upwardly therefrom and the fork further comprises a plurality of corresponding slot members for receiving the plurality of stubs.

12. The control knob assembly of claim 11, wherein at least one of the plurality of stubs includes an outer surface and at least one of the plurality of slot members includes an inner surface, the inner and outer surfaces engaged to and being parallel to each other, and each inner and outer surface being at non-right angles relative to the mounting surface.

13. The control knob assembly of claim 11, wherein each slot member is an elongated aperture enclosed on the fork such that corresponding stubs are movable therewithin between an open state and a closed state defined by a position of the tab.

14. The control knob assembly of claim 11, wherein each slot member includes a pair of adjacent grooved engagements formed thereon such that corresponding stubs are movable from one groove engagement to another grooved engagement between an open state and a closed state defined by the position of the tab.

15. The control knob assembly of claim 7, wherein the gear further comprises a limiting member such that when the limiting member engages the detent the gear is no longer rotatable.

16. A method for setting a controllable device to a set position using a control knob assembly, the control knob assembly comprising:

a rotating shaft operably coupled with a controllable device, the rotating shaft extending through a mounting surface;

a base having a base opening, the base fixed to the mounting surface with the rotating shaft extending through the base opening;

a fork having a detent extending upwardly therefrom and a tab extending radially outwardly therefrom, the fork positioned on top of the base and slidably engaged therewith;

a gear having a gear opening, a plurality of teeth with the teeth configured to receive the detent, and an upper groove positioned on an upper edge, the gear being positioned on top of the fork with the rotating shaft extending through the gear opening;

a knob having a cavity extending longitudinally within an underside of the knob and fixedly engaged to the rotating shaft above the base, fork and gear with the tab extending radially outwardly from underneath the knob; and a biasing member secured on the knob underside and extending downwardly therefrom, wherein the biasing member is configured to engage the gear upper groove such that when engaged the gear rotates with the knob;

wherein when the tab is in a first position the detent is not engaged with the gear teeth, and when the tab is in a second position the detent is engaged with the gear teeth.

17. The method of claim 16, wherein the set position is established by:

engaging the biasing member with the upper groove while the tab is in the first position and rotating the knob to a desired position; and moving the tab to the second position such that the detent engages the teeth, thereby preventing the gear from rotating.

18. The method of claim 17, wherein the controllable device is returned to the set position by rotating the knob and returning the biasing member to the upper groove while the tab is in the second position.

19. The method of claim 16, wherein the control knob assembly further comprises a limiting member disposed on the gear.

20. The method of claim 19, wherein the controllable device is reset before setting the set position by: setting the tab to the first position and rotating the knob such that the biasing member engages the upper groove; and further rotating the knob until the limiting member engages the detent.

* * * * *